US008085957B2

(12) United States Patent
Shishov et al.

(10) Patent No.: US 8,085,957 B2
(45) Date of Patent: Dec. 27, 2011

(54) METHOD FOR CONVERTING ELECTRIC SIGNALS INTO ACOUSTIC OSCILLATIONS AND AN ELECTRIC GAS-KINETIC TRANSDUCER

(76) Inventors: Sergey Vladimirovich Shishov, Moskovskaya (RU); Sergey Alexandrovich Andrianov, Moskovskaya (RU); Sergey Pavlovich Dmitriev, St. Petersburg (RU); Dmitriy Victorovich Ruchkin, Moskovskaya (RU)

( * ) Notice: Subject to any disclaimer, the term of this patent is extended or adjusted under 35 U.S.C. 154(b) by 371 days.

(21) Appl. No.: 12/312,412

(22) PCT Filed: Nov. 10, 2006

(86) PCT No.: PCT/RU2006/000589

§ 371 (c)(1),
(2), (4) Date: Jun. 16, 2009

(87) PCT Pub. No.: WO2008/057004

PCT Pub. Date: May 15, 2008

(65) Prior Publication Data

US 2010/0046789 A1 Feb. 25, 2010

(51) Int. Cl.
*H04R 25/00* (2006.01)
*H04R 3/00* (2006.01)

(52) U.S. Cl. ..... 381/191; 381/113; 381/116

(58) Field of Classification Search ..... 381/191, 381/192, 113, 116, 174
See application file for complete search history.

(56) References Cited

U.S. PATENT DOCUMENTS 6,480,614 B1 11/2002 Denda et al.

FOREIGN PATENT DOCUMENTS

DE 41 15 221 12/1992
EP 0 620 049 10/1994

(Continued)

OTHER PUBLICATIONS

International Search Report.

*Primary Examiner* — Curtis Kuntz
*Assistant Examiner* — Sunita Joshi
(74) *Attorney, Agent, or Firm* — Collard & Roe, P.C.

(57) ABSTRACT

The invention relates to electroacoustic engineering, in particular to methods for converting electric signals into acoustic oscillations and to electroacoustic transducers. The method for converting electric signals into acoustic oscillations comprises exposing an oscillating system that is a gas medium pre-structured by a static electric field to an electric/electromagnetic field modulated in strength by an alternating electric signal in accordance with the shape and frequency of the modulating signal, and converting the energy of the field into acoustic energy to be released thereupon into the ambient. An electric gas-kinetic transducer developed to perform this method comprises a dielectric working element and at least two current-conducting plates that can be connected to the pole terminals of a direct voltage source and to a source of alternating electric signals. The operating principle of the transducer consists in converting the energy of the electric/electromagnetic field into the kinetic energy of gas, and then the kinetic energy of gas into acoustic radiation. This work is performed by gas filling nano/micro-sized channels of the capillary pore matrix of the working element under the effect of the external electric/electromagnetic field. An electric signal is converted into acoustic oscillations without involving mechanical intermediary devices, making it possible to avoid amplitude-phase and amplitude-frequency distortions and to reach a matching between the properties of the oscillating system, or a pre-structured gas medium, and the properties of the transmitting medium, or air, thereby improving the efficiency of conversion.

9 Claims, 8 Drawing Sheets

FOREIGN PATENT DOCUMENTS

| | | | |
|---|---|---|---|
| RU | 2 010 459 | | 3/1994 |
| RU | 2 071 186 | | 4/1997 |
| RU | 2 179 788 | | 2/2002 |
| RU | 2 184 622 | | 7/2002 |
| RU | 2184622 | C2 * | 7/2002 |
| RU | 1 839 970 | | 6/2006 |
| WO | WO 99/03304 | | 1/1999 |

* cited by examiner

METHOD FOR CONVERTING ELECTRIC SIGNALS INTO ACOUSTIC OSCILLATIONS AND AN ELECTRIC GAS-KINETIC TRANSDUCER

CROSS REFERENCE TO RELATED APPLICATIONS

This application is the National Stage of PCT/RU2006/000589 filed on Nov. 10, 2006. Priority of this application is also claimed under 35 U.S.C. §119. The international application under PCT article 21(2) was not published in English.

The invention relates to electroacoustic engineering, in particular to methods for converting electric signals into acoustic oscillations and to electroacoustic transducers. The invention makes it possible to convert electric signals into acoustic oscillations and can be used in acoustic devices such as loudspeakers for reproducing music and voice, and also in various specialized devices for fulfilling applied functions.

Mechanical intermediary devices of various types are used in all prior art methods for converting electric signals into acoustic oscillations and in practical designs of loudspeakers carrying out these methods.

Electrodynamic Conversion Method. A large number of electrodynamic systems is used in prior art in which a piston in the form of a resonant horn of various forms and designs is used as the mechanical intermediary device. For example, a flat acoustic transducer is disclosed in Patent PCT/JP 98/02503 of Jun. 5, 1998, Patent PCT/WO 99/03304 of Jan. 21, 1999, and Patent RU No. 2179788 of Feb. 16, 2002, in which electric signals are converted into sound signals by a movable vibrating membrane.

Electrostatic Conversion Method. An electrostatic loudspeaker is disclosed in Patent RU No. 2010459 of Mar. 3, 1994. A membrane placed in the air spacing between two fixed perforated electrodes functions as a mechanical intermediary device in this invention. As polarizing voltage is applied to the membrane symmetrically relative to the electrodes and as sound voltage is connected asymmetrically to the electrodes, the membrane begins to vibrate under the effect of the difference between the forces of attraction to the electrodes in time with audio-frequency oscillations.

Electrostatic Martin Logan speakers known in the art comprise three principal elements—two stators, a diaphragm of a thin transparent material functioning as a mechanical intermediary device, and the so-called spacers. The spacers restrict the freedom of movement of the diaphragm between the stators.

Electromagnetic Conversion Method. Prior art Magneplanar planar acoustic systems were developed by Magnepan company on the basis of strip and quasi-strip transmitters in which the intermediary device is a very thin strip of corrugated metal foil, or metal foil glued to a Dacron diaphragm that vibrates in accordance with the shape of current flowing therein in the field of powerful permanent magnets made in the form of rods extending parallel to the strip.

A prior art electroacoustic transducer disclosed in Patent RU No. 2071186 of Apr. 16, 1997, has a mechanical intermediary device in the form of a stack comprising a set of alternating flat conducting and dielectric layers produced by sputtering on one another. The stack is placed in a strong alternating magnetic field and the leads of the stack plates are connected to a direct current generator. Ampere's alternating force is applied periodically to the plates to compress or extend the low-elasticity dielectric substrate between the conducting plates. Since, however, one side of the stack is fixed firmly in place, the other side vibrates at the frequency of the magnetic field generator because of change in the total volume of the stack. The volume change causes acoustic waves.

Electrostrictive Conversion Method. A prior art electrostrictive speaker model comprises a mechanical intermediary device that is made of a soft silicon polymer placed between two layers of a flexible current-conducting material that changes its shape under the effect of an electric field.

Another device for generating acoustic oscillations and mechanical vibrations disclosed in Patent RU No. 2184622 of Jun. 10, 2002 is an electrostrictive transducer using an amorphous dielectric material having a dipole structure as a mechanical intermediary device placed between current-conducting plates.

Piezoelectric Conversion Method. Several transducer types use piezoelectric materials as a mechanical intermediary device. A change in the voltage applied causes the degree of deformation of the piezoelectric material to change accordingly so that acoustic waves are generated.

Method Using Aerodynamic Conversion of Electric Audio Frequency Signals. A device using this method causes a transparent panel to vibrate under the pressure of air generated by a transducer placed in the space behind the panel. This technique allows air pressure to be transmitted across the entire panel surface that actually serves as a mechanical intermediary device generating acoustic oscillations.

Distributed Vibration Method. Prior art acoustic NXT panels are excited by one or several special-purpose transducers fixed at certain points on the panel. In this instance, the panel material itself serves as a mechanical intermediary device in which complex vibration processes are caused to occur.

For all the differences in design and methods for generating acoustic oscillations, all the foregoing acoustic systems have a common drawback. They introduce amplitude-phase and amplitude-frequency distortions because of their mechanical vibratory system that is made of materials having properties distinct from the properties of the conducting medium (air) and have actually reached the limit of efficiency in converting an electric signal into acoustic oscillations by causing a mechanical intermediary device to move.

In an optimal situation, had 100% of the energy of the mechanical intermediary device been transmitted to the ambient air, significant losses and distortions of the signal applied would have occurred. Moreover, losses and distortions occur at all conversion stages as well. For example, conversion of an electric signal into an acoustic signal in electrodynamic loudspeakers has at least four stages. Electric signal energy is converted into magnetic energy that is then converted into the kinetic energy of the loudspeaker horn. The horn, in its turn, generates sound waves in the air. The sound waves carry the acoustic energy of sound oscillations that are heard by the human ear. An obvious solution eliminating undesired effects is one in which electric energy is converted directly into acoustic energy without the use of mechanical intermediary devices and intermediary stages.

Ion plasma transmitters, with attempts to develop them made as early as the 1930s, are an example of this approach. They produce a sort of plasma in the air, its geometric characteristics changing with audio frequency. The varying plasma volume generates lengthwise pulses in the air, that is, it fulfills the same function as the resonant horn of a conventional loudspeaker or another mechanical intermediary device. A disadvantage of such transducers is gradual pulverization of the electrode material and its deposition on the discharge tube walls, limiting the service life of the tube because of increasing noise.

It is an object of this invention to develop an effective method for converting electric signals into acoustic oscillations and an electroacoustic transducer to perform the method so that alternating electric signals are converted efficiently into acoustic oscillations with a high sensitivity, minimum distortions, and a high front increase and decline rate.

The technical result that can be produced by exercising the invention consists in that the properties of the oscillating system are matched with those of the transmitting medium without using a mechanical intermediary device or its functional analogues having physical properties different from the properties of the conducting medium (air) or intermediate stages of electric signal conversion, and that the efficiency of electric signal conversion into acoustic oscillations is improved.

This technical result is achieved in a method for converting electric signals into acoustic oscillations by exposing an oscillating system that is a pre-structured gas medium by an electric/electromagnetic field modulated by an alternating electric signal for exciting it, in accordance with the shape and frequency of the electric signal applied, and converting the energy of this field into acoustic energy that is released thereafter into the ambient.

An electric gas-kinetic transducer developed for performing this method comprises a dielectric working element and at least two current-conducting plates that can be connected to the pole terminals of a direct current source and a source of alternating electric signals, said plates comprising one layer or multiple layers of macro-, and/or micro-, and/or nano-level dimensions having different topologies and relative spatial locations, at least one of the plates being optionally gas-permeable and/or designed as an electrode system, or an open-pore matrix; the dielectric working element being a single- or multi-layered heterodynamic system, or a "gas capillary pore matrix" of macro-, and/or micro-, and/or nano-level dimensions having a developed network of nano/micro gas containing channels, the layers of said matrix being optionally separated by a dielectric gas-impermeable layer at any point and having a different spatial location relative to the current-conducting plates/electrode systems. To be operated in uncommon conditions, the transducer may be placed in a tightly sealed housing.

The working element of the transducer may be placed between or on the current-conducting plates that are formed as separated electrode regions adapted to be connected to the pole terminals of a direct current source and a source of alternating electric signals. In the first instance, the working element may consist of at least two layers separated by a dielectric gas-impermeable layer. In the second instance, the working element is covered by an additional current-conducting plate overlapping the area of the electrode regions and cannot be connected to the pole terminals of the direct current source and the source of alternating electric signals.

The transducer may comprise multiple layers and be designed as a stack of alternating current-conducting plates and working elements, at least one of the current-conducting plates being optionally supplied with an additional alternating electric signal from a separate source.

Direct voltage generates a force electric field that affects the gas medium, causing orientation or structuring of the gas medium in the channels and formation of dipole molecules that can oscillate in phase together with changes in field strength. The electric field force, therefore, causes polarization of the gas medium in the channels of the capillary pore matrix and hence its structuring. We have also found experimentally that the original kinetic energy of gas molecules in the nano/micro channels changes under the effect of a direct electric field. An alternating electric signal excites a modulated electric/electromagnetic field, particularly, an electric/electromagnetic field of variable strength. Exposure of the gas medium structured by the direct electric field to the modulated electric/electromagnetic field generates oscillations/pulsations thereof in accordance with the shape and frequency of the field to which the gas medium is exposed, causing generation of acoustic waves having the shape and frequency of the alternating electric signal applied.

FIGS. 3, 4, 5, and 7 show variants of the aforesaid transducer design, in particular, open, enclosed (for operation in unusual conditions, such as liquid and corrosive media), symmetric, and asymmetric.

Figure 6:
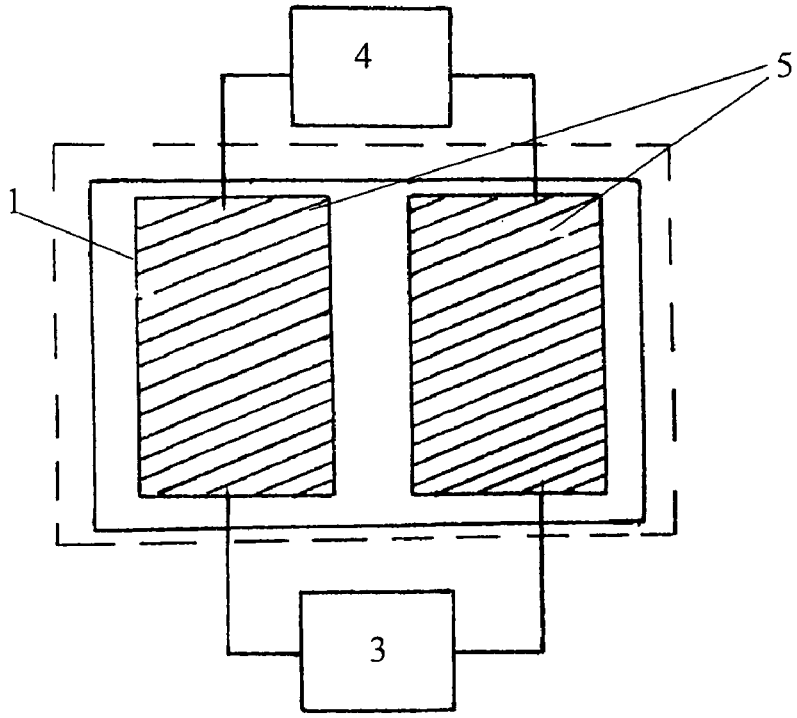
Figure 7:
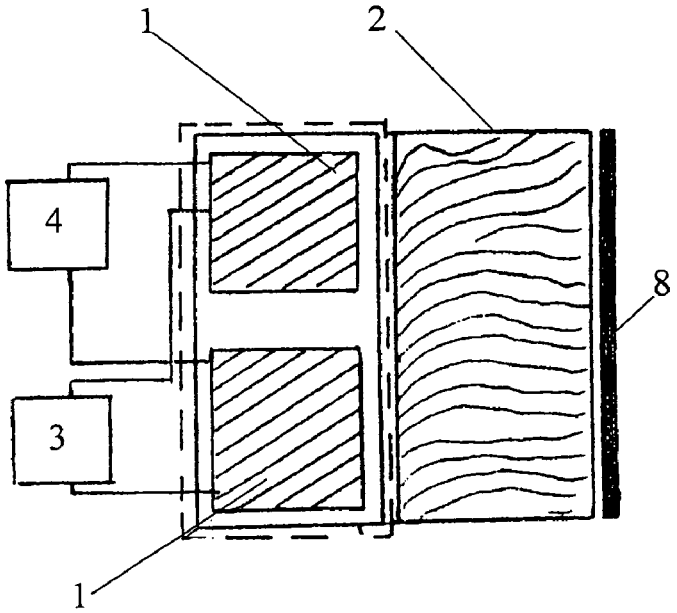

FIG. 6 shows a current-conducting plate of an asymmetrically designed transducer in the form of separated electrode regions.

Figure 8:
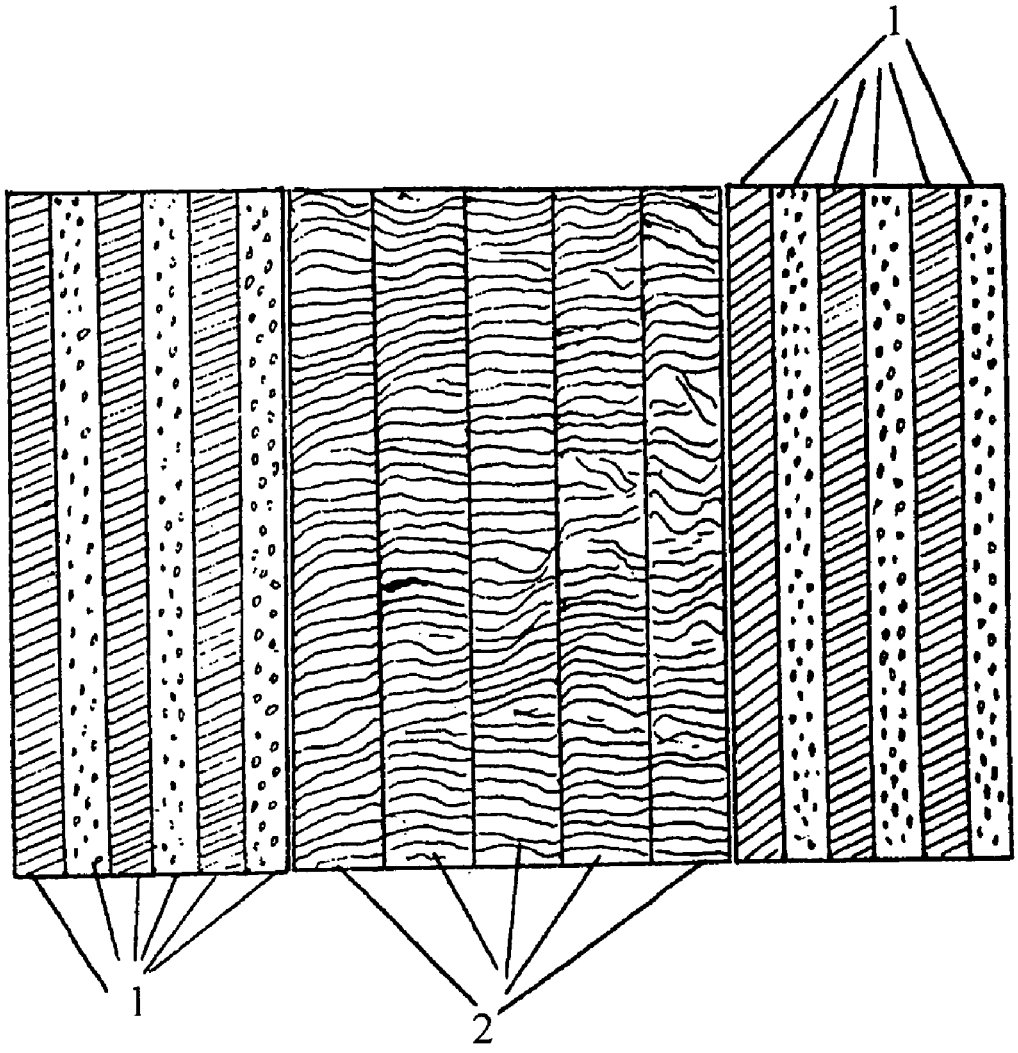

FIG. 8 illustrates a multi-layered transducer of macro-, and/or micro-, and and/or nano-level dimensions.

Figure 9:
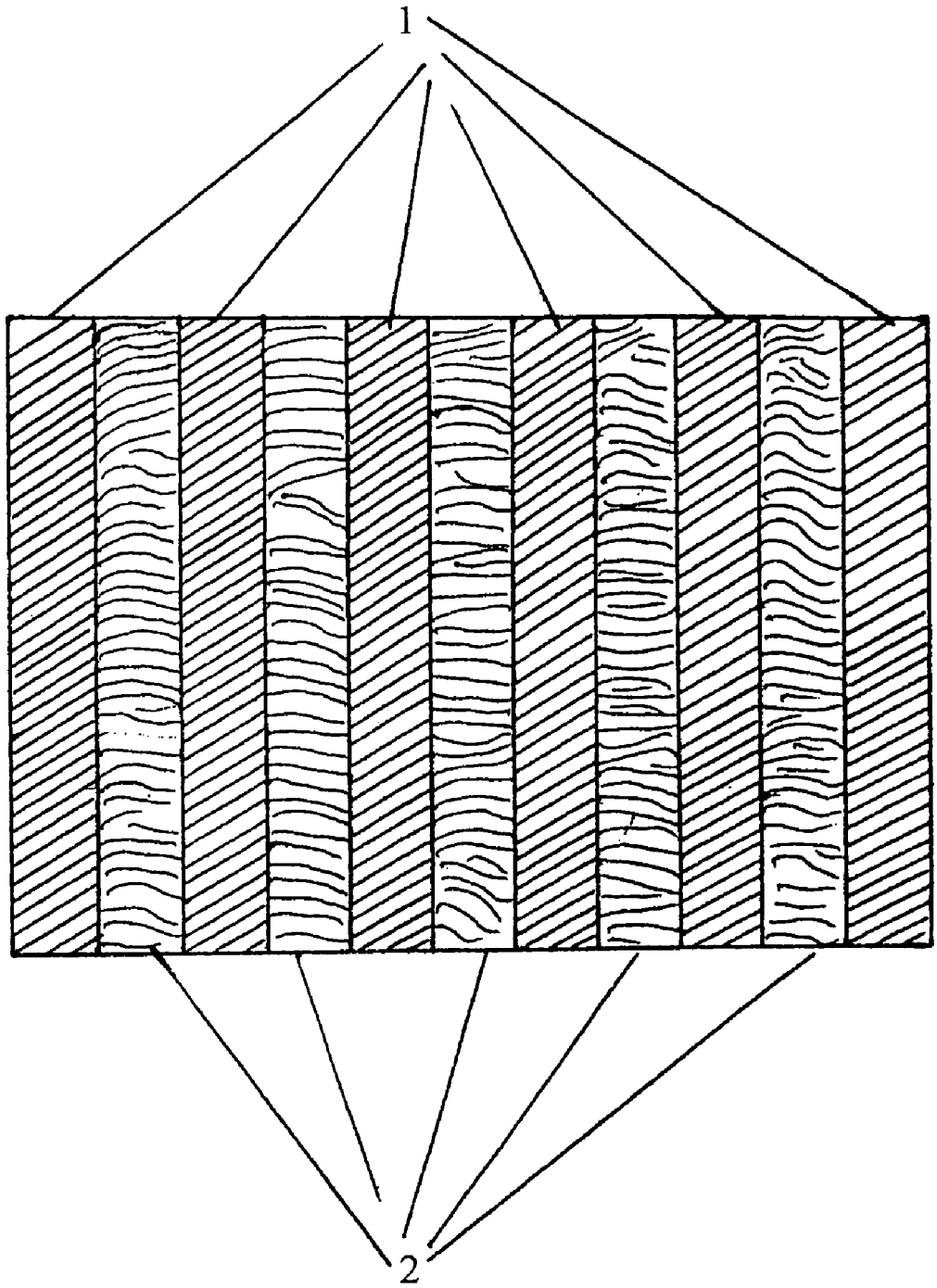

FIG. 9 illustrates a multi-layered transducer in the form of a stack consisting of alternating layers of the working element and current-conducting plates.

Figure 10:
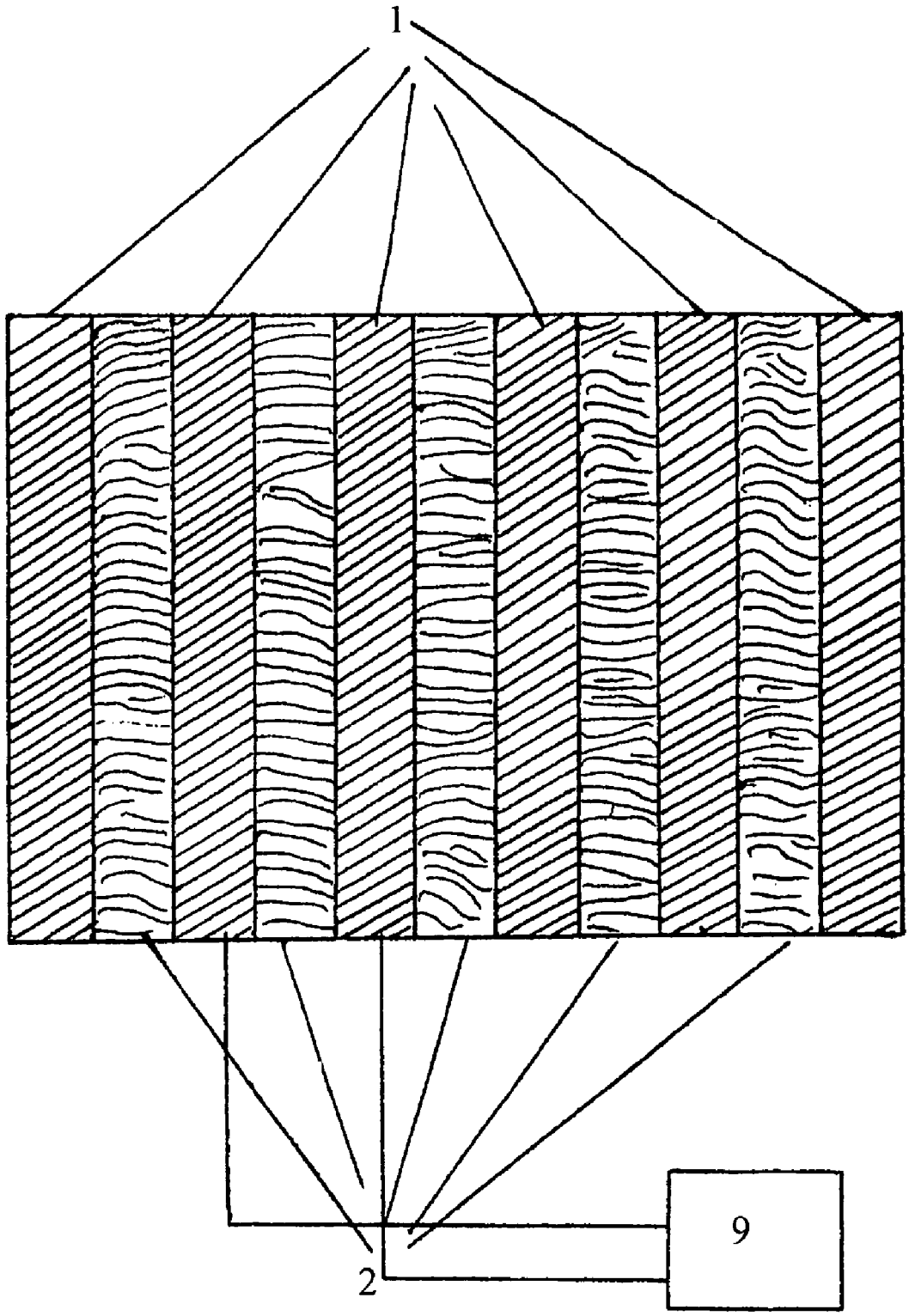

FIG. 10 illustrates a multi-layered transducer having control layers.

The transducer comprises at least two current-conducting plates 1 and a dielectric working element 2. For the transducer to become operational, the current-conducting plates are connected to the pole terminals of a direct voltage source 3 and a source 4 of alternating electric signals.

Current-conducting plates 1 may be manufactured by various methods, from various materials, and by various techniques. When current-conducting layers are deposited on substrates of different dielectric materials they may have different configurations and perforations, provided that the integrity and conductivity of the current-conducting layer are not affected; they may be gas-permeable or gas-impermeable, have different topologies and have multiple layers of macro-, and/or micro-, and/or nano-level dimensions; may be made in the form of an electrode system, such as a porous matrix having open pores forming a developed network of linear or branched channels of varying spatial orientation relative to the longitudinal axis of the current-conducting plates. The electrode layer of current-conducting plates 1 may be divided to produce separate electrode regions 5. Electric connection between the layers may be effected, for example, in the form of apertures. The walls of the apertures are covered with an electrode material so that electric connection is established between the layers. The apertures may be filled with a current-conducting paste. Therefore, electric connections may extend horizontally and vertically. The current-conducting plates adhere tightly to the working element.

Working element 2 is a heterogeneous system, or "gas-capillary pore matrix," in which work is performed by the gas medium filling the matrix pores on the basis of gas-kinetic effects.

The capillary pore matrix of the working element is a matrix based on various existing volume polymers exhibiting dielectric properties. The working body matrix is shaped into a single block of controlled topology (or as discrete capillary pore particles of the matrix) having open pores and forming a developed system of channels of nano/micro dimensions. To improve in-phase pulsation and oscillation of gas filling the matrix, the matrix pores have a size as identical as possible. The specific parameters of the capillary pore matrix of the working element (such as material type, true density of inter-pore material, pore ratio, size and volume of pores, topology and geometry of the matrix, and so on) are chosen to satisfy the specific requirements to the claimed electroacoustic transducer, such as the frequency range, dynamic range, ratio of nonlinear distortions, and so on.

Common atmospheric air is used as the gas component of the working element in an open-type design. Various gases or their mixtures may be used in sealed designs.

The working element is, therefore, a heterogeneous working body comprising a developed system of channels 6 of nano and micro dimensions filled with a gas medium, and having a specific open-flow area and shape, and preferably oriented.

Current-conducting plates 1 and working element 2 can be arranged in the following patterns. In any case, the possibility is to be provided for communication between the channels of the current-conducting plates and the capillary pore matrix of the working element. The structure may be: symmetric (FIG. 5), in which working element 2 is divided into two parts by a gas-impermeable layer 13 and placed between the current-conducting plates 1; asymmetric (FIG. 6 and FIG. 7), in which working element 2 is placed on two current-conducting plates 1, which are formed as separate electrode regions 5 connected to the pole terminals of direct voltage source 3 and source 4 of alternating electric signals, and is covered with a further current-conducting plate 8 that overlaps the area of electrode regions 5; multi-layered of macro-, and/or micro-, and/or nano-level dimensions (FIG. 8), in which 1—multi-layered current-conducting plates and 2—multi-layered working element; multi-layered in the form of a stack of alternating layers of the working element and current-conducting plates (FIG. 9), in which 1—current-conducting plates and 2—working element; and multi-layered with control layers (FIG. 10), in which 1—current-conducting plates, 2—working element, and 9—an additional source of an alternating electric signal.

Figure 4:
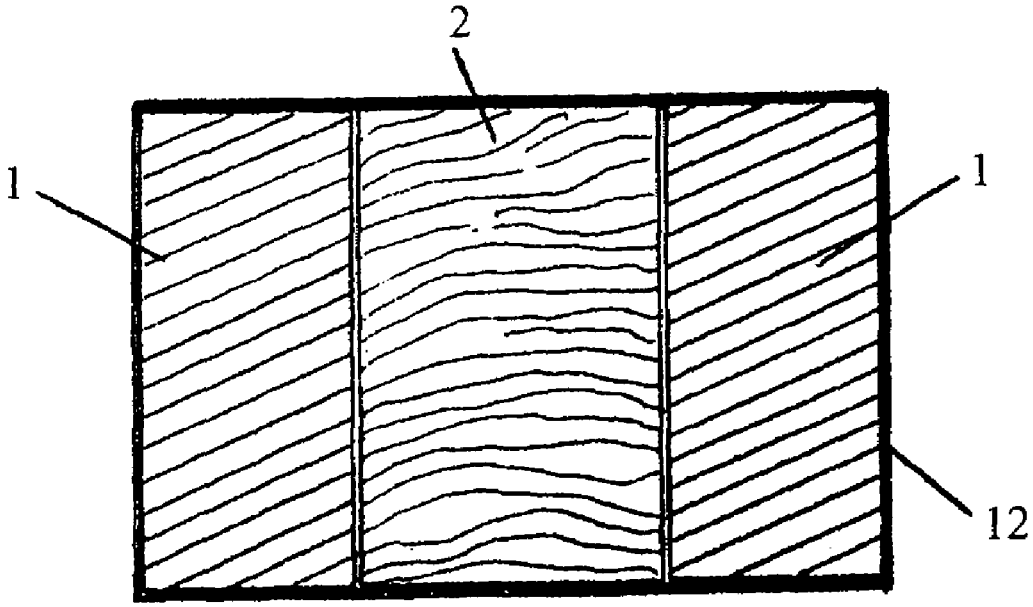
Figure 5:
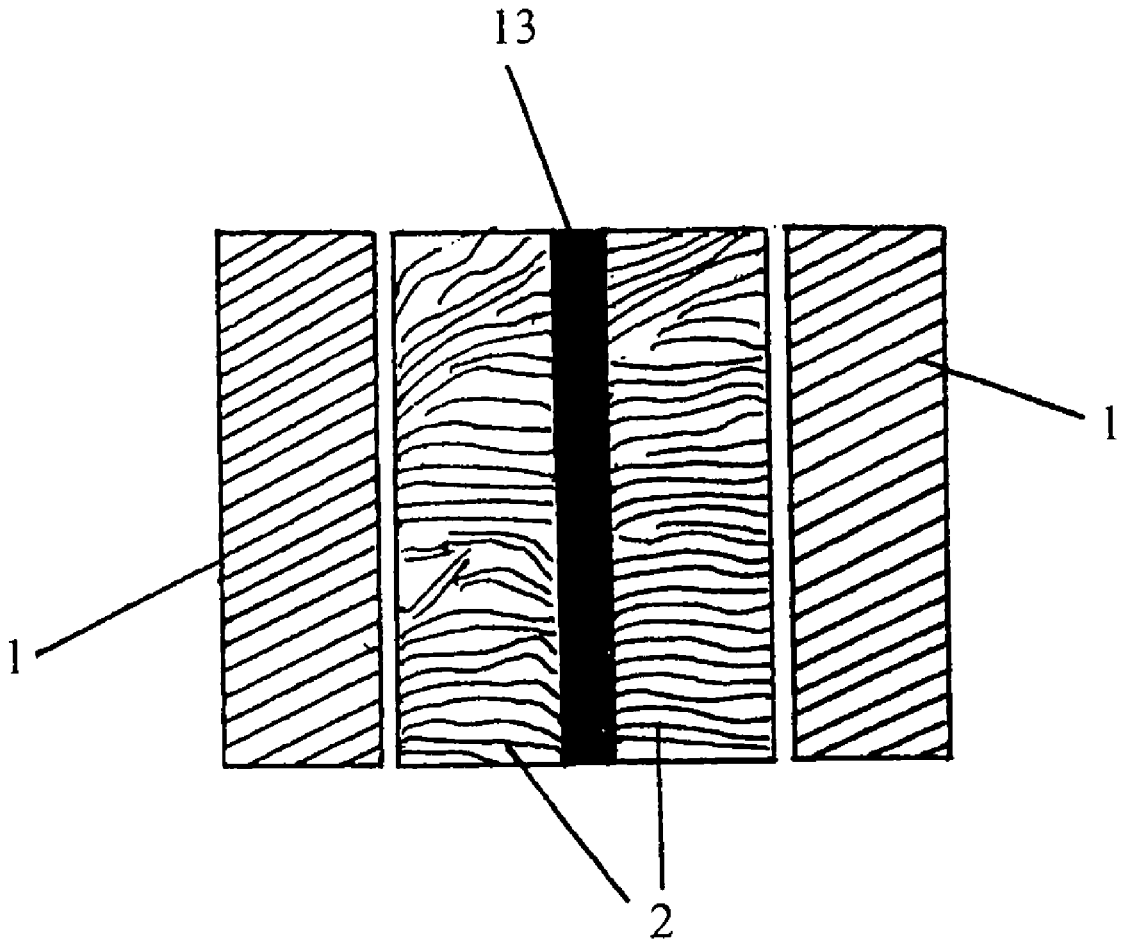

For operation in specific conditions, the transducer may be placed in a tightly sealed housing 12 (FIG. 4).

Figure 2:
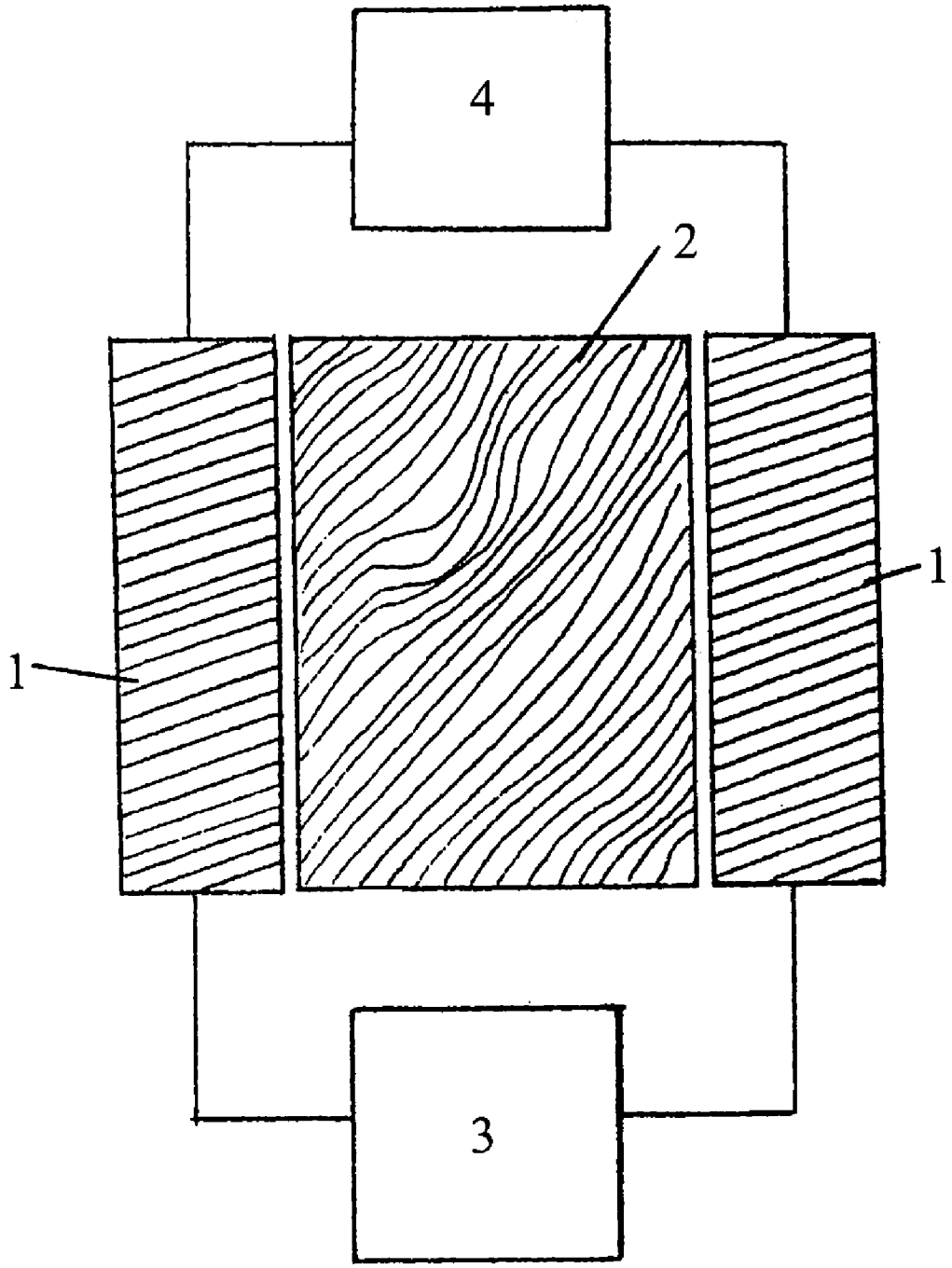
FIG. 2 is a block diagram of the transducer.
Figure 3:
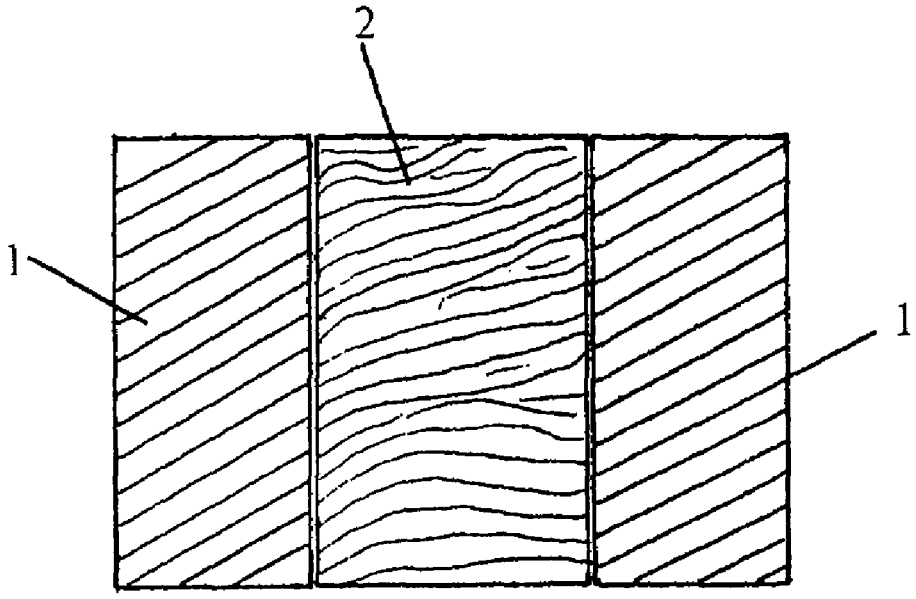

The preferred embodiment of this transducer is shown, as a possible example, in FIG. 2. The transducer comprises two gas-permeable current-conducting plates 1 forming an electrode system. Plates 1 are porous, with open pores over 0.1 micron in diameter that form channels oriented differently relative to the longitudinal axis of the current-conducting plates. The pores of current-conducting plates 1 more than 1 micron in diameter allow the gas filling them to communicate freely with the gas component of the working element. The plates are connected to the pole terminals of direct voltage source 3 capable of regulating the voltage within the range of 10 V to 30 kV, and to source 4 of alternating electric signals, such as optionally the appropriate module of a laser disk player serving to deliver output electric signals to the back end elements of the sound channel. Dielectric working element 2 having a solid-state component made of biopolymer molecules is placed between two current-conducting plates 1.

This invention is not confined to the preferred embodiment thereof. It is obvious that various changes and modifications can be made in accordance with the idea of the invention within the scope thereof as claimed in the claims.

The geometry of a multi-layered structure consisting of alternating layers produces an additional effect as a result of combination of the properties of individual layers making up the structure. Conversion efficiency depends on a number of parameters, in particular: thickness and number of layers making up the structure; electrical conductances of the layers; strength of mechanical connection between the layers; and surface area of the structure. The magnitude of this effect can be controlled by selecting material for the layers and geometric parameters of the structure. Combining several materials makes it possible to manufacture multi-layered structures displaying diverse properties. The choice of technique to manufacture a multi-layered structure depends on the thickness of the layers.

Operation of this electric gas-kinetic transducer requires electronic controls. Electronic controls may actually be manufactured by any existing methods, and will not be described here.

Figure 1:
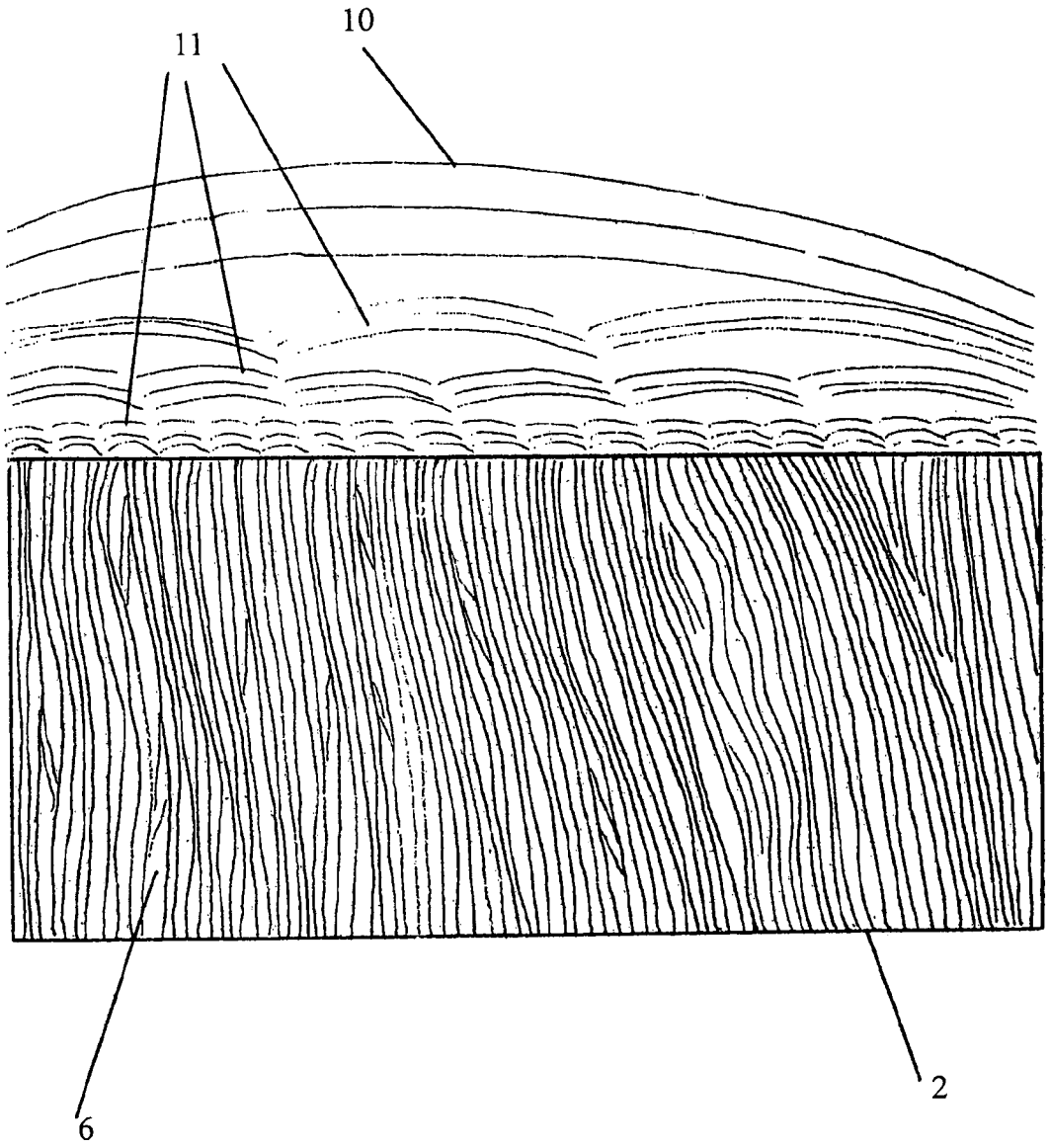
FIG. 1 illustrates a process for producing acoustic oscillations using an oscillating system that is a pre-structured gas medium.

The electric gas-kinetic transducer of this invention operates as follows. Direct voltage 3 and an alternating electric signal from a respective audio component module of acoustic systems 4 are applied to current-conducting plates 1. The transducer is designed so that current-conducting plates 1 are in direct contact with the matrix of working element 2, and the channels of current-conducting plates 1 communicate with the channels of the capillary pore matrix of working element 2. Direct voltage applied to the current-conducting plates induces a force electric field that affects the gas medium. The gas filling the system of channels 6 of the matrix of working element 2 is polarized under the effect of the static electric field and, therefore, structured, and the original kinetic energy of gas molecule movement changes. The alternating electric signal applied to current-conducting plates 1 connected to direct voltage source 3 excites a variable-intensity electric/electromagnetic field modulated by this signal. The modulated electric/electromagnetic field generated in working element 2 causes the dipoles of the gas medium filling the working element channels to oscillate together in phase in accordance with the frequency of the alternating electric signal applied. This causes all the molecules of gas filling the channels of matrix 6 of working element to oscillate in phase in accordance with the shape and frequency of the alternating electric signal and, hence, the modulated electric/electromagnetic field. As a result, an acoustic wave 10 shown in FIG. 1 is generated over the entire surface of the transducer by in-phase addition of a plurality of individual radiations 11 generated by gas oscillation in each of channels 6 of the matrix of working element 2, said wave carrying acoustic energy.

The method for converting electric signals into acoustic oscillations and the electric gas-kinetic transducer performing it disclosed herein are intended to convert an electric signal into acoustic oscillations without requiring mechanical intermediary devices, and their functional analogues, that is, mechanical oscillating or other systems having physical properties that are different from those of air as a conducting medium. This helps achieve a matching between the properties of the oscillating system, which is a pre-structured gas medium in this invention, and the properties of air as a conducting medium.

The absence of intermediate stages of electric signal conversion into acoustic oscillations, and also in-phase operation of all molecules of gas filling the channels of the working element matrix help avoid amplitude-phase and amplitude-frequency distortions inherent in prior art methods and, for this reason, enhance the efficiency of electric signal conversion into acoustic oscillations.

Operation of the electric gas-kinetic transducer of this invention is based on a process developing in the working element that can be described as in-phase operation of a system of gas-kinetic pistons/pumps of nano/micro-level dimensions formed by a system of developed channels 6 of nano/micro-level dimensions in the capillary pore matrix of working element 2. These pistons/pumps operate under the effect of an external static electric and an external modulated electric/electromagnetic field. Such pistons/pumps operate in phase because this method and transducer performing it require pre-structuring of the gas medium, and also because the transducer of this invention is designed so that the current-conducting plates fully overlap the working element and are in direct contact therewith.

The method of this invention and the transducer performing it are capable of causing air itself to sound without converting it into the plasma state and without using a mechanical intermediary device or intermediate stages of electric signal conversion, and, therefore, removing the limitations inherent in ion plasma transmitters and mechanical oscillating systems.

Resolution of this problem helps develop industrial technologies for manufacturing acoustic systems, currently used at home and for commercial purposes, which have a new sound quality and are capable of producing unusual sound effects. Limitations are only imposed by the electronic part of the system (the recording and playback channel as a whole, from microphone and sound recording equipment to amplifier converting the signal transmitted) and the developer's imagination.

The use of this invention in acoustic systems will help produce new sound quality characteristics and offer the possibility of producing a holographic sound picture.

The transducer of this invention helps achieve: a high rate of front increase and decline of the signal reproduced and a very wide dynamic range; produce a uniform acoustic field; create an acoustic surface of a large area and any geometric shapes that produce uncommon sound effects; and obtain thin radiating surfaces of various configurations that can be used as components of furniture, the interior, decorative elements, and room design, for example, sounding ceilings, floors, walls, wallpaper, ceiling and floor covers, advertising boards and projection screens, such as, among other applications, screens for movie houses.

The operating principle of the electroacoustic transducer of this invention consists in converting the energy of an electric/electromagnetic field into kinetic energy of gas, and then the kinetic energy of gas into acoustic radiation, that is, in performing a series of conversions of energy types: energy of an electric/electromagnetic field>kinetic energy of gas>acoustic radiation energy.

Moreover, the work required to convert electric signals into acoustic oscillations is performed by gas filling the matrixes of the electrode systems and the working element under the effect of an external modulated electric/electromagnetic field. The electroacoustic transducer of this invention may, therefore, be called an electric gas-kinetic transducer.

What is claimed is:

1. A method for converting electric signals into acoustic oscillations by exposing an oscillating system that is a gas medium pre-structured by a static electric field to an electric/electromagnetic field modulated in strength by an alternating electric signal in accordance with the shape and frequency of the modulating signal applied, and converting the energy of said field into acoustic energy that is released thereafter into the ambient.

2. An electric gas-kinetic transducer comprising a dielectric working element and at least two current-conducting plates that can be connected to the pole terminals of a direct current source and to a source of alternating electric signals, said plates comprising a single layer or multiple layers of macro-, and/or micro-, and/or nano-level dimensions, and having different topologies and relative spatial position, at least one of said plates being optionally permeable to gas and/or be designed as an electrode system, or an open pore matrix; the dielectric working element being a single- or multi-layered heterodynamic system, or "gas-capillary pore matrix," of macro-, and/or micro-, and/or nano-level dimensions having a developed network of nano/micro gas containing channels, the layers of the system being optionally separated by a dielectric gas-impermeable layer at any point thereof and occupying a different spatial location relative to the current-conducting plates/electrode systems.

3. The transducer as claimed in claim 2, which is placed in a tightly sealed enclosed housing.

4. The transducer as claimed in claim 2, wherein the working element is placed between two current-conducting plates.

5. The transducer as claimed in claim 4, wherein the working element comprises at least two layers separated by a dielectric gas-impermeable layer.

6. The transducer as claimed in claim 2, wherein the working element is placed on two current-conducting plates that are formed as separated electrode regions that can be connected to the pole terminals of a direct current source and a source of alternating electric signals, and is covered with an additional current-conducting plate overlapping the area of the electrode regions, said additional plate being disconnected from the pole terminals of the direct current source and the source of alternating electric signals.

7. The transducer as claimed in claim 2, which comprises a plurality of layers in the form of a stack, said transducer further having at least one working element and at least one current-conducting plate, said working element and said current conducting plate alternating.

8. The transducer as claimed in claim 2, which has a plurality of layers in the form of a stack comprising alternating layers of current-conducting plates and a working element, wherein at least two current-conducting plates within the stack can be further supplied with an alternating electric signal from a separate source.

9. The transducer as claimed in claim 2, which has a plurality of layers of macro-, and/or micro-, and/or nano-level dimensions.

* * * * *